US009666039B2

(12) United States Patent
Chen et al.

(10) Patent No.: US 9,666,039 B2
(45) Date of Patent: May 30, 2017

(54) VISUAL NOTIFICATION DEVICE AND DRIVING METHOD THEREOF

(71) Applicant: Siemens Schweiz AG, Zurich (CH)

(72) Inventors: Li Guo Chen, Beijing (CN); Rui Ting Ren, Beijing (CN); Xue Song Shen, Beijing (CN); Jian Tan, Beijing (CN)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 15/247,351

(22) Filed: Aug. 25, 2016

(65) Prior Publication Data

US 2017/0061752 A1 Mar. 2, 2017

(30) Foreign Application Priority Data

Aug. 28, 2015 (CN) ..... 2015 1 0544074

(51) Int. Cl.

| | |
|---|---|
| ***G08B 3/00*** | (2006.01) |
| ***G08B 5/38*** | (2006.01) |
| ***G05F 3/02*** | (2006.01) |
| ***G08B 17/00*** | (2006.01) |

(52) U.S. Cl.

CPC ..... *G08B 5/38* (2013.01); *G05F 3/02* (2013.01); *G08B 17/00* (2013.01)

(58) Field of Classification Search

CPC ..... G08B 5/38; G08B 17/00; G05F 3/02
USPC ..... 340/691.8
See application file for complete search history.

(56) References Cited

U.S. PATENT DOCUMENTS

| | | | | |
|---|---|---|---|---|
| 5,329,171 | A * | 7/1994 | Shimizu | H03K 5/2481 327/78 |
| 2002/0125840 | A1 | 9/2002 | Ha et al. | 315/291 |
| 2005/0219060 | A1 | 10/2005 | Curran et al. | 340/815.45 |
| 2006/0158810 | A1* | 7/2006 | Tamosaitis | H02H 9/002 361/93.1 |
| 2012/0286696 | A1* | 11/2012 | Ghanem | H05B 33/0815 315/291 |

FOREIGN PATENT DOCUMENTS

| | | | |
|---|---|---|---|
| AU | 2008200904 B2 | 3/2009 | H02J 1/00 |
| CN | 2422693 Y | 3/2001 | G08B 5/36 |
| CN | 201035667 Y | 3/2008 | G08B 13/16 |

(Continued)

OTHER PUBLICATIONS

European Extended Search Report, Application No. 16181169, 5 pages, dated Jan. 26, 2017.

*Primary Examiner* — Kerri McNally
(74) *Attorney, Agent, or Firm* — Slayden Grubert Beard PLLC

(57) ABSTRACT

A visual notification device in a fire-fighting system may include an input end, a booster circuit, an energy storage element, at least one flash element, and a flash control circuit, for causing energy in the energy storage element to be applied to the at least one flash element to make it flash. At least one of the booster circuit, the at least one flash element, and the flash control circuit is designed such that a residual voltage across the energy storage element in each flash operation is greater than or equal to the input voltage. The visual notification device may enable the occurrence of a repetitive inrush current to be suppressed effectively without the addition of a current-limiting circuit.

14 Claims, 9 Drawing Sheets

(56) References Cited

FOREIGN PATENT DOCUMENTS

| | | | | |
|---|---|---|---|---|
| CN | 201047967 | Y | 4/2008 | ..... G08B 5/38 |
| CN | 104766418 | A | 7/2015 | ..... G08B 5/38 |
| JP | 3041660 | B2 | 5/2000 | ..... G03B 15/05 |

* cited by examiner

VISUAL NOTIFICATION DEVICE AND DRIVING METHOD THEREOF

CROSS-REFERENCE TO RELATED APPLICATIONS

This application claims priority to CN Application No. 201510544074.6 filed Aug. 28, 2015, the contents of which are hereby incorporated by reference in their entirety.

TECHNICAL FIELD

The present invention relates in general to the fire alarm field, in particular to a notification device (notification appliance) capable of emitting a visual alert (visual alarm) in a fire-fighting system.

BACKGROUND

FIG. 1 shows a schematic diagram of a typical fire alarm system. As FIG. 1 shows, in the fire alarm system 100, a fire alarm control apparatus (Control Panel) 110 is connected to multiple fire detectors 120, notification devices 130 or manual alarms 140 etc. distributed throughout a building. The fire detectors 120, notification devices 130 and manual alarms 140 may be collectively referred to as peripheral devices. These peripheral devices may be connected to the fire alarm control apparatus (Control Panel) 110 via a wired or wireless network, and may obtain electrical energy from a line connected to the fire alarm control apparatus. In the fire alarm system shown in FIG. 1, the notification device 130 may for example emit a sound alert audible to a human (e.g. by means of a buzzer or loudspeaker), and may also emit a visual alert which can be observed by a human (e.g. using flashing light (a strobe)). For example a visual alert using flashing light is especially suitable for alerting people with a hearing impairment, and is also especially suitable for the noisy environment of a large shopping mall for example.

In the prior art, a notification device uses a xenon lamp or light-emitting diode (LED) as a flash element. In order to trigger the action of the flash element, it is generally necessary to provide an energy storage element in the notification device, e.g. a capacitor. The energy storage element can store a high level of electric energy, in order to provide the high voltage needed to trigger the xenon lamp or LED. FIG. 2 shows a circuit block diagram of a common notification device with an LED as a flash element. In FIG. 2, the notification device 200 for example comprises an input end 210, a current-limiting circuit 220, a booster circuit 230, an energy storage element 240, a flash control circuit 250 and an LED 260 connected in sequence. Specifically, the booster circuit 230 boosts an input voltage Vin received by the input end 210, and charges the energy storage element 240 to the boosted voltage value Vcap. When charging is complete, the voltage across the energy storage element 240 is higher than the input voltage Vin of the input end. The energy stored in the energy storage element 240 is used to supply the LED 260 for flashing. The flash control circuit 250 controls when the LED flashes, when it stops flashing, and the flashing intensity. In general, the LED flashes periodically, e.g. at a flashing frequency of 1 Hz, with the duration of each flash being approximately a few tens of milliseconds.

Each time the LED flashes, a drive current flows through the LED under the control of the flash control circuit 250, causing the LED to light up. At the same time, since the flashing of the LED consumes electrical energy, the voltage across the energy storage element 240 gradually falls and reaches its lowest point, also called the residual voltage Vr, when the flash ends. In general, the residual voltage Vr across the energy storage element 240 in each flash operation or after the flash will be less than the input voltage Vin of the input end. This causes a large current to flow for a short time from the input end to the energy storage element. A large current within a short space of time is generally called an inrush current. Such inrush currents occurring during periodic flashing are called repetitive inrush currents. Considering factors such as the flashing frequency (maximum 1 Hz) and power losses, it is generally very difficult to control such a repetitive inrush current.

In view of this, a current-limiting circuit 220 is also provided in the example shown in FIG. 2. The current-limiting circuit 220 can sense, in real time, the size of current flowing to the energy storage element 240, and compare it with a fixed threshold. If the current at the present time exceeds the threshold, the booster circuit pauses operation, and waits for the current to fall back to below the threshold, and thereby suppresses the occurrence of a repetitive inrush current. U.S. Pat. No. 724,314 describes a structure of a current-limiting circuit with the abovementioned similar function.

SUMMARY

One embodiment provides a visual notification device, comprising an input end, for receiving an input voltage; a booster circuit, coupled to the input end so as to boost the input voltage; an energy storage element, coupled to the booster circuit and charged by the booster circuit; at least one flash element; and a flash control circuit, coupled to the energy storage element and the flash element, and used for causing energy in the energy storage element to be applied to the at least one flash element to make it flash; wherein at least one of the booster circuit, the at least one flash element and the flash control circuit (450, 550, 650, 750) is designed such that a residual voltage across the energy storage element in each flash operation is greater than or equal to the input voltage.

In one embodiment, the flash control circuit is designed to stop applying energy to the flash element before the residual voltage becomes less than the input voltage.

In one embodiment, the flash control circuit also comprises a controlled switch element connected in series with the at least one flash element, the switch element being designed to conduct during a flash and to turn off before the residual voltage becomes less than the input voltage.

In one embodiment, the flash element is a xenon lamp, and the switch element is an IGBT.

In one embodiment, the flash control circuit also comprises a clamping element connected in series with the at least one flash element, wherein the sum of a clamping voltage of the clamping element and an intrinsic voltage drop of the flash element is greater than or equal to the input voltage.

In one embodiment, the flash element comprises at least two series-connected LEDs, and the intrinsic voltage drop is the total sum of the forward voltage drops of the at least two LEDs.

In one embodiment, the flash element is a xenon lamp, and the intrinsic voltage drop is a residual voltage of the xenon lamp after each flash.

In one embodiment, the booster circuit charges the energy storage element at least to a minimum voltage, and wherein the minimum voltage is calculated on the basis of the energy consumed by the flash operation and the input voltage.

In one embodiment, the flash control circuit comprises a step-down circuit, which lowers the voltage across the energy storage element to a voltage suitable for causing the at least one flash element to flash.

In one embodiment, the flash element is an LED, and the total forward voltage drop of the at least one flash element is equal to or greater than the input voltage.

Another embodiment provides a driving method for a visual notification device, comprising receiving an input voltage inputted to the notification device; boosting the input voltage; using the boosted voltage to charge an energy storage element; applying energy stored in the energy storage element to at least one flash element, to make it flash; and making at least one flash element stop the flash, such that a residual voltage across the energy storage element in each flash process is greater than or equal to the input voltage.

In one embodiment, the charging step comprises charging the energy storage element at least to a minimum voltage, wherein the minimum voltage is calculated on the basis of the input voltage and the energy consumed by each flash.

In one embodiment, the driving method includes selecting the at least one flash element such that a total intrinsic voltage drop of the at least one flash element is equal to or greater than the input voltage.

In one embodiment, the driving method includes providing a clamping element connected in series with the at least one flash element, wherein the sum of a clamping voltage of the clamping element and the total intrinsic voltage drop of the at least one flash element is greater than or equal to the input voltage.

BRIEF DESCRIPTION OF THE DRAWINGS

Example aspects and embodiments of the invention are described below with reference to the figures, in which.

DETAILED DESCRIPTION

Figure 1:
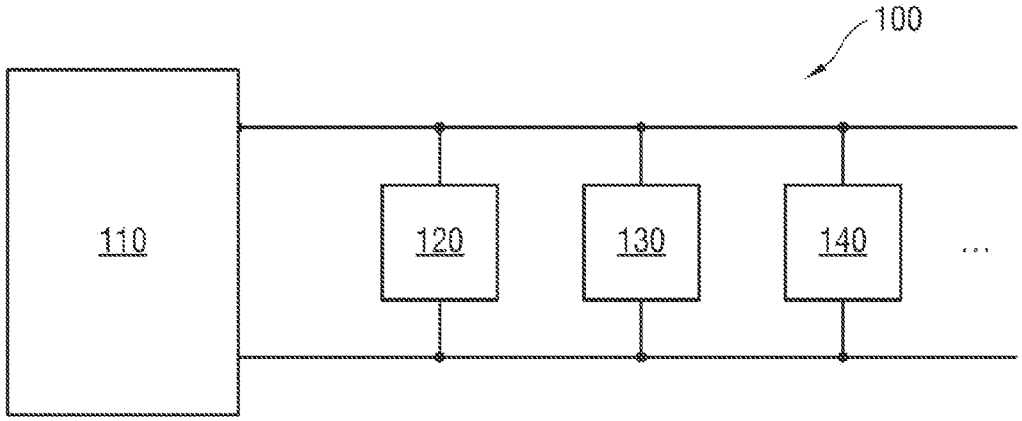
FIG. 1 shows a schematic diagram of a typical fire-fighting system.

Some embodiments of the invention provide a visual notification device in a fire-fighting system, capable of suppressing the occurrence of a repetitive inrush current in the notification device without the need to add a current-limiting circuit.

According to one embodiment, the notification device in the fire-fighting system proposed by the present invention comprises: an input end, for receiving an input voltage; a booster circuit, coupled to the input end so as to boost the input voltage; an energy storage element, coupled to the booster circuit and charged by the booster circuit; at least one flash element; a flash control circuit, coupled to the energy storage element and the flash element, and used for causing energy in the energy storage element to be applied to the at least one flash element to make it flash; wherein at least one of the booster circuit, the at least one flash element and the flash control circuit is designed such that a residual voltage Vr across the energy storage element in each flash operation is greater than or equal to the input voltage Vin. Using the notification device proposed by the present invention enables the occurrence of a repetitive inrush current to be suppressed effectively without the addition of a current-limiting circuit.

Preferably, the flash control circuit is designed to stop applying energy to the flash element before the residual voltage Vr becomes less than the input voltage Vin. Preferably, the flash control circuit also comprises a controlled switch element connected in series with the at least one flash element, the switch element being designed to conduct during a flash and to turn off before the residual voltage Vr becomes less than the input voltage Vin. More preferably, the controlled switch element is integrated in the flash control circuit. Optionally, the flash element is a xenon lamp, and the switch element is an IGBT.

Using the notification device described above enables the application of energy to be made to stop before Vr becomes less than Vin by means of the switch element in the flash control circuit. Thus, suppression of a repetitive inrush current can be realized simply by controlling the times at which the switch element in the flash control circuit opens and closes. Such a solution does not require a current-limiting circuit, so the energy consumption caused by the use of a current-limiting resistor etc. will not occur, and such a solution is convenient and flexible.

Preferably, the flash control circuit also comprises a clamping element connected in series with the at least one flash element, wherein the sum of a clamping voltage Vclamp of the clamping element and an intrinsic voltage drop of the flash element is greater than or equal to the input voltage. Preferably, the flash element comprises at least two series-connected LEDs, and the intrinsic voltage drop is the total sum of forward voltage drops of the at least two LEDs. Optionally, the flash element is a xenon lamp, and the intrinsic voltage drop is a residual voltage of the xenon lamp after each flash.

Using such a notification device, the object of suppressing a repetitive inrush current can be realized by adding a simple clamping element, with no need for the control logic of the flash control circuit to be affected at all. Such a solution is more convenient, and easily realized.

Preferably, the booster circuit charges the energy storage element at least to a minimum voltage Vmin, wherein the minimum voltage Vmin is calculated on the basis of energy consumed by each flash and the input voltage Vin. Preferably, the flash control circuit also comprises a step-down circuit, which lowers the voltage across the energy storage element to a voltage level suitable for driving the at least one flash element.

Such a notification device suppresses a repetitive inrush current by increasing the maximum capacitor voltage to which the energy storage element is charged, and at the same time provides the energy needed for a flash. Such a solution can likewise suppress a repetitive inrush current without the need to add a current-limiting circuit. Moreover, such a solution can also guarantee the energy needed for a flash, and can provide multiple flash light intensity requirements over a broader range. Using the solution proposed by the present invention enables the residual voltage across the energy storage element to be a substantially fixed value. This characteristic facilitates calculation of the duty cycle of charge/discharge times of the energy storage element. For example, when the notification device supports multiple different light intensity setting requirements (e.g. 110 Candelas, 75 Candelas, etc.) or the input voltage changes, it may be necessary to calculate and set the duty cycle of charge/discharge times of the capacitor again. In this case, using the solution proposed by the present invention enables the duty cycle to be updated using a more convenient algorithm.

Preferably, the flash element is an LED, and the total forward voltage drop of the at least one flash element is equal to or greater than the input voltage Vin. This solution realizes inrush current suppression purely through rational selection of the forward voltage drops and the number of LEDs. This solution does not change any other existing circuit, and is therefore especially easy to realize, with lower design costs.

Other embodiments provide a driving method for a visual notification device. The method comprises: receiving an input voltage inputted to the notification device; boosting the input voltage; using the boosted voltage to charge an energy storage element; applying energy stored in the energy storage element to at least one flash element, to make it flash; making at least one flash element stop the flash, such that a residual voltage across the energy storage element in each flash process is greater than or equal to the input voltage.

Preferably, the charging step comprises: charging the energy storage element at least to a minimum voltage Vmin, wherein the minimum voltage Vmin is calculated on the basis of the input voltage Vin and the energy consumed by each flash. The driving method also comprises: selecting the at least one flash element such that a total intrinsic voltage drop of the at least one flash element is equal to or greater than the input voltage. Optionally, the driving method also comprises: providing a clamping element connected in series with the at least one flash element, wherein the sum of a clamping voltage of the clamping element and the total intrinsic voltage drop of the at least one flash element is greater than or equal to the input voltage.

Preferred embodiments are explained below in a clear and easy-to-understand way in conjunction with the accompanying drawings, to further illustrate the above characteristics, technical features and advantages of the present invention and forms of implementation thereof.

To furnish a clearer understanding of the technical features, objects and effects of the present invention, particular embodiments thereof are now explained with reference to the accompanying drawings, in which identical labels indicate components with the same structure or components with similar structures but the same function.

In this text, "schematic" means "serving as a real instance, an example or an illustration". No drawing or embodiment described as "schematic" herein should be interpreted as a more preferred or more advantageous technical solution.

To make the drawings appear uncluttered, only those parts relevant to the present invention are shown schematically in the drawings; they do not represent the actual structure thereof as a product. Furthermore, to make the drawings appear uncluttered for ease of understanding, in the case of components having the same structure or function in certain drawings, only one of these is drawn schematically, or only one is marked.

In this text, "a" does not only mean "just this one", but may also mean the case of "more than one". Moreover, in this text, "first" and "second" etc. are merely used to differentiate between parts, not to indicate their order and degrees of importance, etc.

In order to suppress a repetitive inrush current, the inventors of the present invention propose that it is necessary to design the circuit of the notification device such that the residual voltage Vr across the energy storage element is always higher than the input voltage Vin in each flash operation. The "flash operation" mentioned here means: once power-on of the notification device is complete, the process of the energy storage element being charged to a maximum value, the energy storage element discharging and the flash element flashing, and the voltage across the energy storage element after discharge being the residual voltage Vr.

Figure 3:
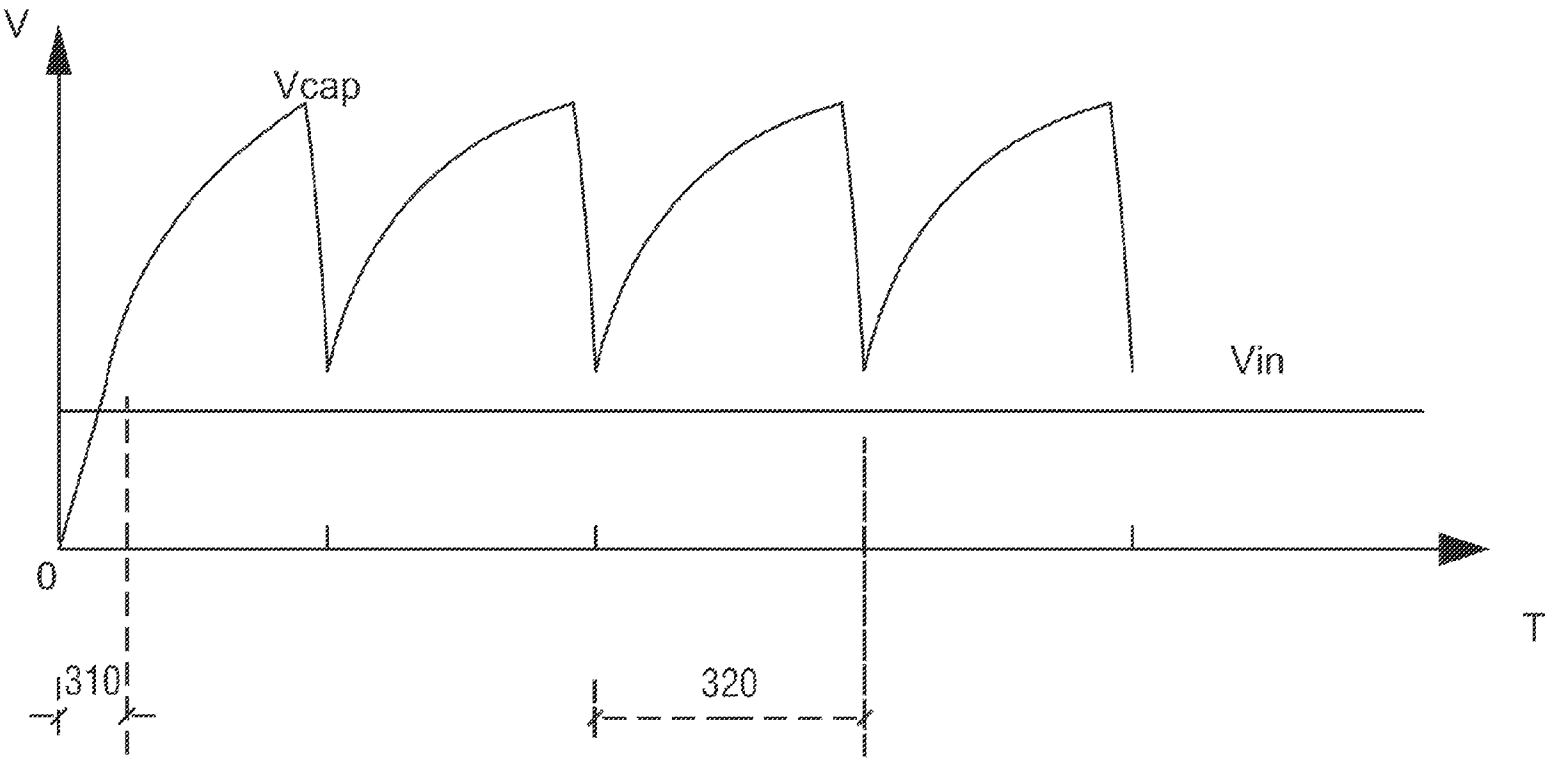
FIG. 3 shows a waveform graph of the voltage across an energy storage element according to an embodiment of the present invention.

FIG. 3 shows a waveform graph of the voltage across the energy storage element according to an embodiment of the present invention. As FIG. 3 shows, at the beginning of power-on of the notification device, the voltage across the energy storage element, for example a capacitor, begins charging from zero, and gradually charges to a level greater than the input voltage Vin. The process of the voltage across the energy storage element rising from zero to a value higher than the input voltage Vin is called in the initial process 310. After the initial process is complete, the voltage across the energy storage element is charged to a peak value Vcap; this process is called the charging process. In turn, the flash element flashes, and since the flash consumes stored energy, the voltage across the energy storage element falls to a minimum value, i.e. a residual voltage Vr, after discharge; this process is called the discharging process. In the next flash operation, the energy storage element undergoes the charging process and the discharging process again. Thus, the process completed by an energy storage element from charging to discharging is a complete flash operation 320. As FIG. 3 shows, the present invention proposes that the residual voltage across the energy storage element in this complete flash operation must always be higher than the maximum value of the input voltage. It will thus be possible to suppress the occurrence of a repetitive inrush current during periodic flashing to the maximum extent possible.

In order to realize the voltage waveform graph shown in FIG. 3, the inventors of the present invention have proposed several particular embodiments. For example, in a first embodiment, the flash duration of the flash element can be controlled, such that it stops the flash before the residual voltage Vr of the energy storage element becomes lower than the input voltage Vin. As another example, in a second embodiment, the maximum voltage Vcap to which the energy storage element is charged can be increased, such that Vcap is increased to a level at which the residual voltage Vr across the energy storage element after the flash is still greater than or equal to the input voltage Vin. Those skilled in the art will appreciate that these two methods may also be used in combination, i.e. with Vcap being increased to a certain extent while the flash duration is controlled, as long as the result of the combination of the two methods is that the residual voltage Vr is greater than or equal to the input voltage Vin.

An elaboration is set out below in conjunction with particular embodiments. In the accompanying drawings below, identical components are indicated using identical labels, and have the same functions. For the sake of conciseness, the component is only described in detail when it first appears, and details are not repeated if it is mentioned later.

Figure 2:
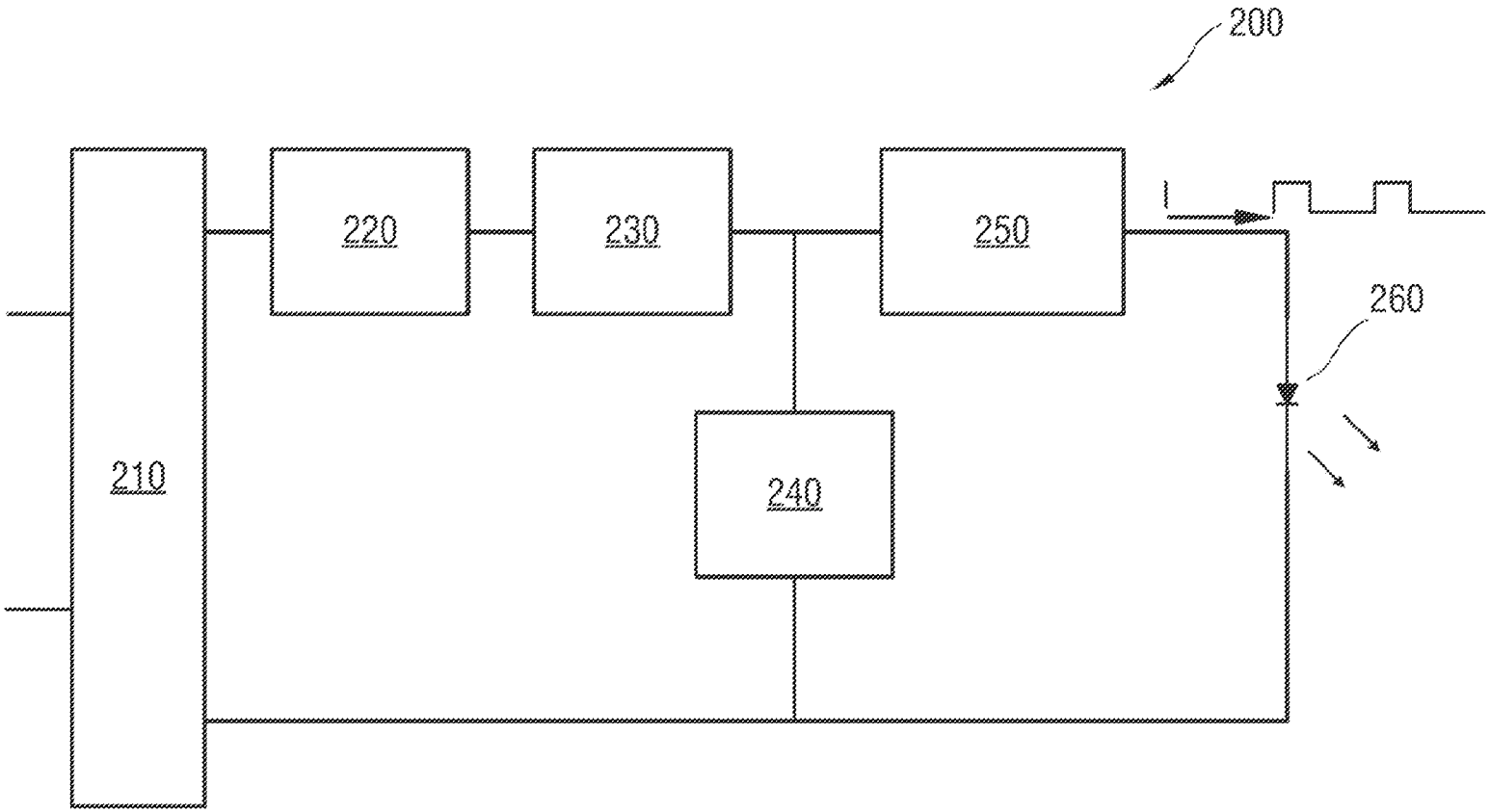
FIG. 2 shows a circuit diagram of a visual notification device in the prior art.
Figure 4:
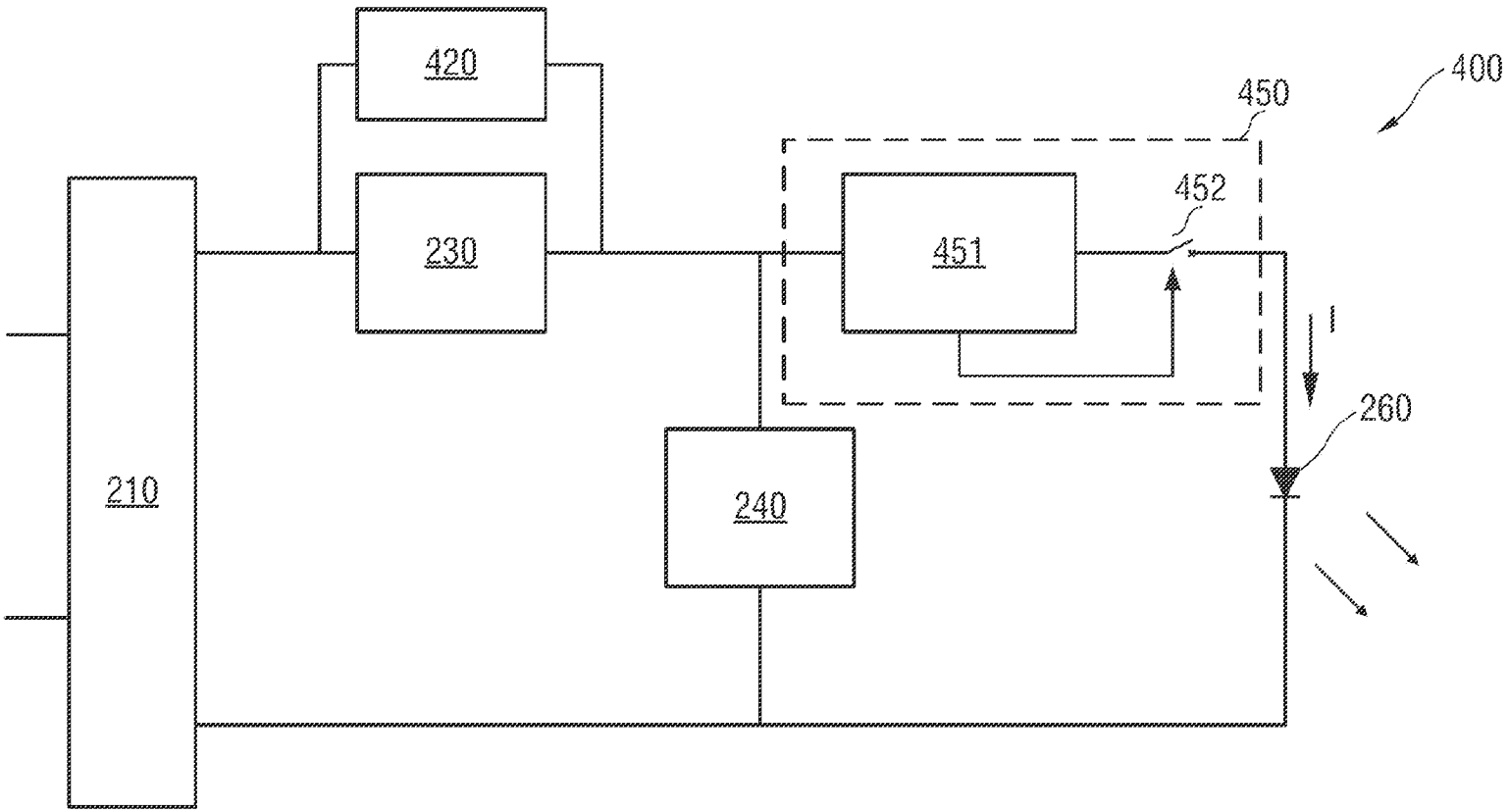
FIG. 4 shows a circuit diagram of a notification device according to an embodiment of the present invention.

FIG. 4 shows a circuit block diagram according to an embodiment of the present invention. The visual notification device 400 shown in FIG. 4 comprises an input end 210, a current-limiting circuit 420, a booster circuit 230, a capacitor 240, a flash control circuit 450 and an LED 260. As shown in FIG. 4, similarly to FIG. 2 which shows the prior art, the input end 210 receives electrical energy from a line. A voltage received at the input end 210 is the input voltage Vin. The booster circuit 230 is coupled to the input end 210, and boosts the input voltage Vin to a higher voltage. The capacitor 240 serving as an energy storage element is coupled to the booster circuit 230, and can be charged to Vcap by the booster circuit 230. The flash control circuit 450 and the LED 260 serving as a flash element are connected in series, and powered by the capacitor 240. The flash control circuit 450 can control the size and duration of current flowing through the LED 260 during a flash, and thereby control the light intensity of the flash and the flash duration. FIG. 4 also shows a current-limiting circuit 420. The function of the current-limiting circuit 420 is not to suppress a repetitive inrush current, but to limit an inrush current appearing in the initial phase of power-on (i.e. in the initial process mentioned above when the capacitor charges from zero to more than Vin). The current-limiting circuit 420 may for example be a current-limiting resistor.

Unlike the prior art, in FIG. 4, the flash control circuit 450 may specifically comprise a drive control circuit 451 and a controlled switch element 452, both of which are connected in series in a loop containing the LED 260. The drive control circuit 451 on the one hand supplies a drive current to the LED, and on the other hand controls the switch element 452. Optionally, the drive control circuit 451 may comprise a microcontroller and a driver adapted to the LED. According to the voltage waveform graph shown in FIG. 3, the switch element 452 conducts for example when the LED initiates a flash, and turns off when the LED flash ends. When the LED flashes, the voltage across the capacitor 240 gradually falls to a residual voltage Vr after discharge. The drive circuit 451 can make the switch element 452 cut off the drive current flowing through the LED before the residual voltage Vr falls below the input voltage Vin, i.e. stop the supply of electrical energy to the LED 260 by the capacitor 240. It can thus be ensured that the residual voltage Vr across the capacitor 240 is equal to or higher than the input voltage Vin, so as to suppress the occurrence of a repetitive inrush current. Preferably, the drive control circuit 451 and the switch element 452 may also be integrated together, i.e. as the flash control circuit 450. The integrated flash control circuit 450 can control the duration of the drive current flowing through the LED 260, i.e. the flash duration Ton of the LED. Ton may be set to stop before Vr becomes less than Vin. Here, the switch element 452 may be a bipolar junction transistor, and may also be a controlled switch element of another type.

Figure 5:
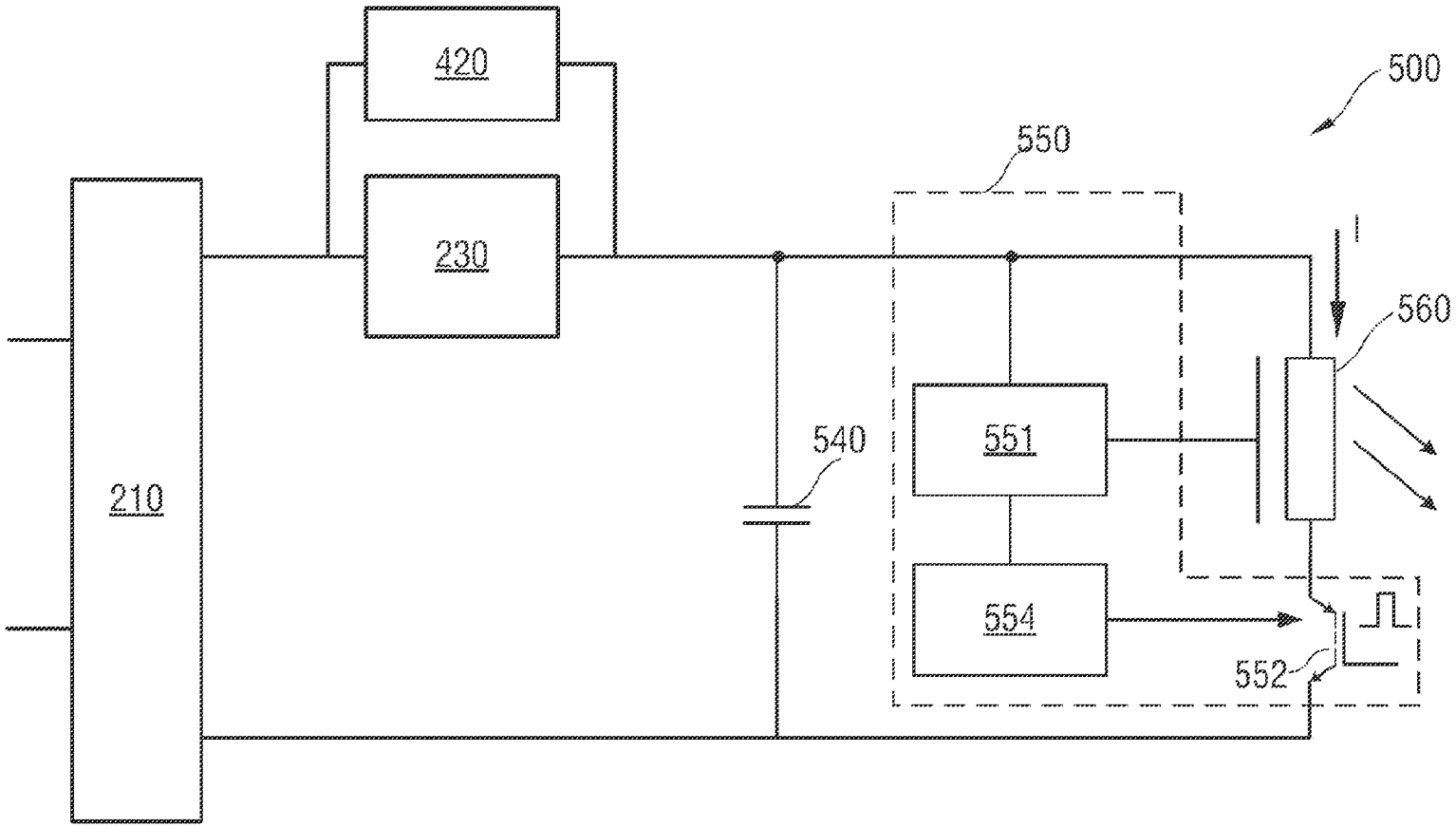
FIG. 5 shows a circuit diagram of a notification device according to another embodiment of the present invention.

FIG. 5 shows by way of example a circuit block diagram of a notification device according to another embodiment of the present invention. In the example of FIG. 5, the flash element is a xenon lamp 560. The notification device 500 in FIG. 5 comprises an input end 210, a current-limiting circuit 420, a booster circuit 530, a capacitor 540, a trigger circuit 551, a xenon lamp 560 and an IGBT 552. Similarly to FIG. 4, the booster circuit 530 is coupled to the input end 210, and boosts the input voltage Vin to a voltage value suitable for triggering the xenon lamp. Here, the current-limiting circuit 420 is likewise used to suppress an inrush current in the initial process, not a repetitive inrush current appearing in flash operations. The energy storage element is still a capacitor. A difference is that the energy storage capability of the capacitor 540 here is stronger, in order to provide the energy needed for the xenon lamp to flash. A flash control circuit 550 comprises a trigger circuit 551, which can provide a sufficiently high trigger voltage when the xenon lamp needs to light up. Under the action of a trigger voltage, gas in the xenon lamp ionizes and emits light. The flashing of the xenon lamp consumes energy, and the voltage Vr across the capacitor 540 falls to a low point.

Unlike the prior art, in the example of FIG. 5, the flash control circuit 550 may for example comprise the trigger circuit 551, a switch element IGBT 552, and a microcontroller 554 connected to the trigger circuit 551 and the IGBT 552. The switch element 552 may cut off a current path of the xenon lamp 560 before the residual voltage Vr across the capacitor 540 becomes less than Vin under the control of the microcontroller 554, i.e. stop the supply of power to the xenon lamp 560 by the capacitor 540. Since the instantaneous current of the xenon lamp 560 when it is triggered reaches 100 A or more, an IGBT capable of tolerating a large current is preferably used as the switch element here.

Figure 6:
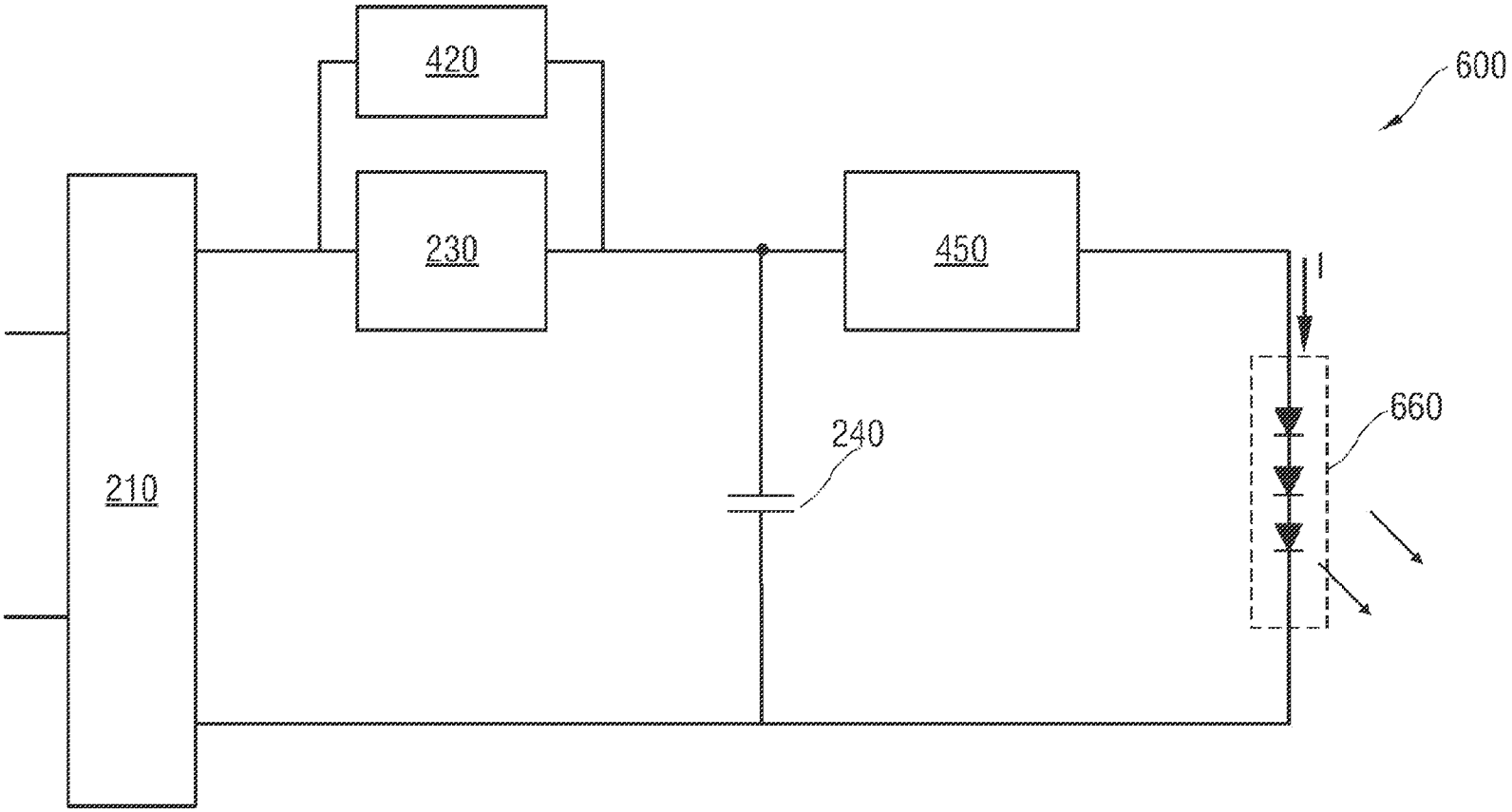
FIG. 6 shows a circuit diagram of a notification device according to another embodiment of the present invention.

FIG. 6 shows a notification device circuit 600 according to another embodiment of the present invention. In FIG. 6, the notification device circuit 600 comprises an input end 210, a current-limiting circuit 420, a booster circuit 230, a capacitor 240, a flash control circuit 250 and a flash element 660. A component which is different from the prior art is the flash element LED 660. In the example shown in FIG. 6, the flash element 660 comprises a group of series-connected LEDs. The forward voltage drops (forward drops) of the LEDs connected in series with one another are added together to form an inherent voltage drop Vfd of the flash element 660. When the voltage across the capacitor 240 is higher than Vfd, the capacitor 240 applies energy to the LEDs, and only then can a drive current flow through each LED and light up each LED. When the voltage across the capacitor 240 is equal to Vfd, the flash stops. Thus, further in accordance with the requirements of the waveform in FIG. 3, if it is desired that the residual voltage Vr across the capacitor 240 is always equal to or higher than the input voltage Vin, then it is only necessary for Vfd to be equal to or greater than Vin. In other words, a suitable number of LEDs connected in series may be selected to form the flash element 660, with the inherent voltage drop Vfd thereof being the sum of the forward voltage drops of the LEDs. Such a flash element stops a flash when Vr=Vfd>=Vin, so that a repetitive inrush current can be suppressed. Optionally, a single high-power LED may also be selected as the flash element 660, with the forward voltage drop Vfd of the LED itself being greater than or equal to the input voltage Vin.

In addition, a xenon lamp may also be selected as the flash element in the notification device circuit 600 shown in FIG. 6. In this case, a trigger circuit for the xenon lamp may have the structure shown in FIG. 5. Unlike FIG. 5, there is no longer a need for an IGBT 552; instead, a suitable xenon lamp is selected with an intrinsic voltage drop thereof after a flash being greater than or equal to Vin.

Figure 7:
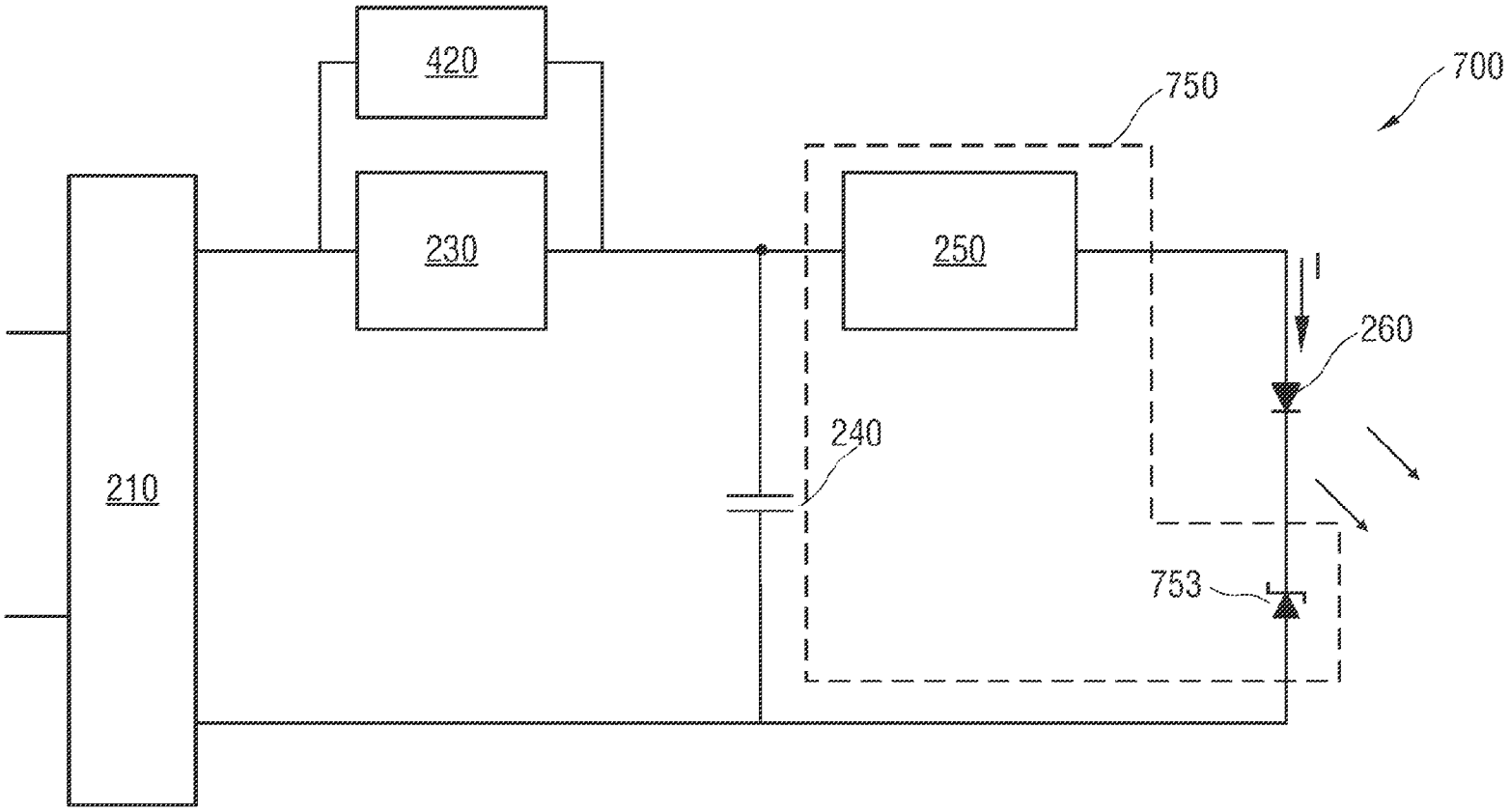
FIG. 7 shows a circuit diagram of a notification device according to another embodiment of the present invention.

FIG. 7 shows by way of example a notification device circuit 700 according to another embodiment of the present invention. As FIG. 7 shows, the notification device 700 comprises an input end 210, a current-limiting circuit 420, a booster circuit 230, a capacitor 240, a flash control circuit 750 and a flash element 260 such as an LED. Unlike previous examples, in addition to a part 250 which is similar to FIG. 2, the flash control circuit 750 also comprises a voltage clamping element 753 connected in series with the flash element 260. The voltage clamping element 753 may for example be a clamping diode D1 or another electronic element capable of realizing voltage clamping. The sum of the clamping voltage Vclamp and the intrinsic voltage drop (e.g. Vfd) of the flash element 260 should be greater than or equal to the input voltage Vin, i.e. Vclamp+Vfd>=Vin. When the residual voltage Vr across the capacitor 240 is equal to Vclamp+Vfd, the capacitor 240 stops supplying power to the flash element 260, and the drive current is interrupted. Thus, it can be ensured that Vr is always equal to or greater than Vin in each flash operation, so as to suppress a repetitive inrush current. Optionally, the flash element 260 may also be a xenon lamp, and correspondingly, the flash control circuit may be a trigger circuit as shown in FIG. 5. In this case, a voltage clamping element can likewise be connected in series with the xenon lamp; the voltage clamping element in this case is preferably a TVS (transient voltage suppressor) element suitable for tolerating a large current. Similar to the situation in FIG. 7, the sum of the clamping voltage of the TVS and the intrinsic voltage drop of the xenon lamp itself should be equal to or greater than the input voltage Vin. In this way, a repetitive inrush current can be suppressed without the need for a special current-limiting circuit. For example, if the input voltage is 32 V, and the intrinsic voltage drop of the xenon lamp itself is approximately 23-18 V, then a TVS with a minimum clamping voltage of 12 V can be selected.

Figure 8:
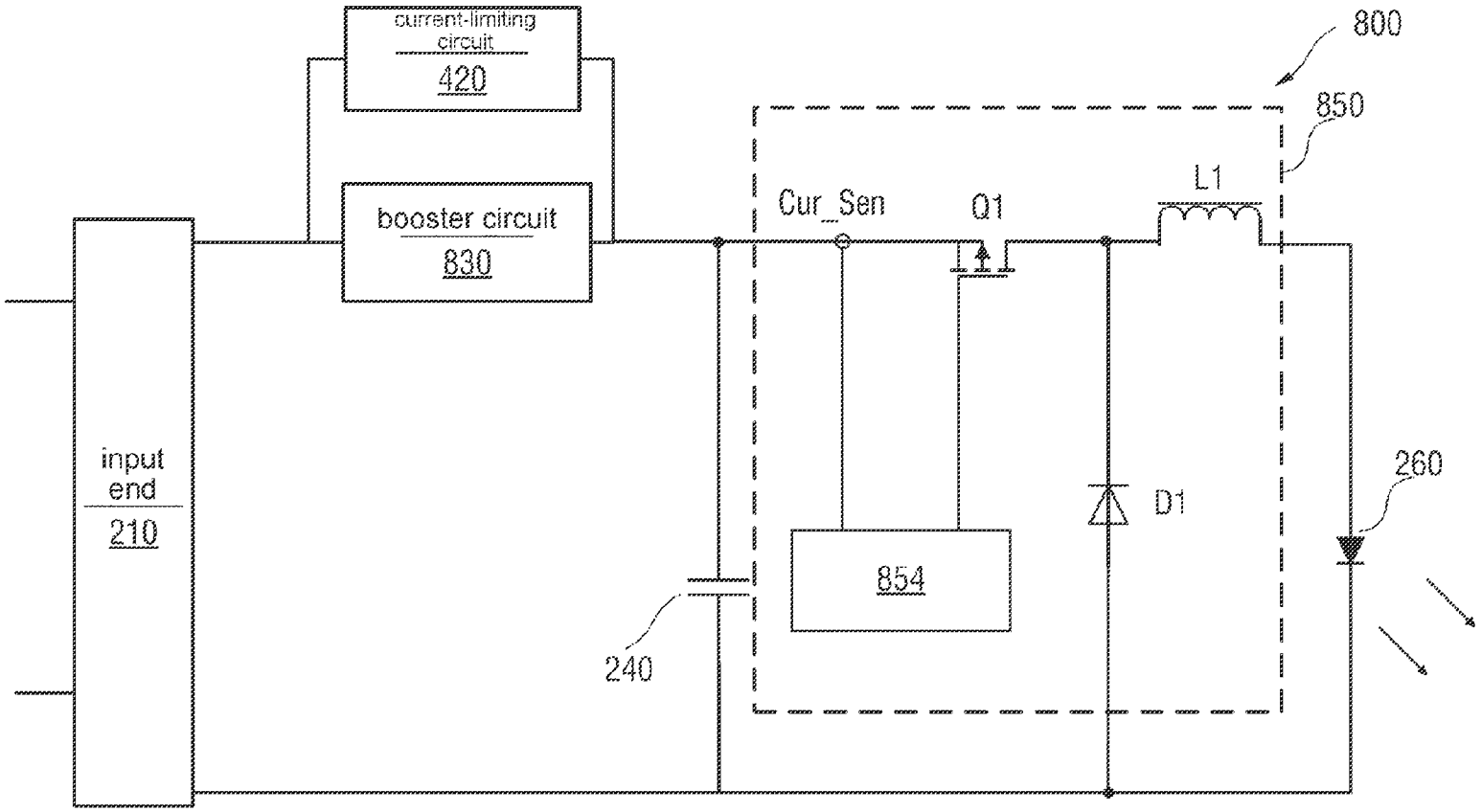
FIG. 8 shows a circuit diagram of a notification device according to another embodiment of the present invention.

FIG. 8 shows a circuit block diagram of a notification device 800 according to another embodiment of the present invention. As FIG. 8 shows, the flash element 260 is still an LED. The notification device 800 comprises an input end 210, a booster circuit 830, a current-limiting circuit 420, a capacitor 240 and a flash control circuit 850. Here, the same labels are used for components which are the same as in the preceding drawings, and if such components have the same functions as before, the details will not be repeated here. Unlike previous embodiments, the booster circuit 830 charges the capacitor 240 at least to a minimum charge voltage value Vmin. Vmin is the input voltage Vin plus an equivalent voltage which is equivalent to the energy consumed by a flash. An example is given below to describe in detail how Vmin is determined.

First of all, suppose that the intensity of light which the LED 260 needs to output is 110 Candelas. To achieve this, the LED for example flashes for 20 ms within each interval of one second, i.e. Ton=20 ms, and the size of the forward current $I_{fd}$ which flows through the LED is 2 amperes. Suppose furthermore that the LED has a forward voltage drop $V_{fd}$=21 V (the total voltage drop for multiple LEDs) when the forward current is 2 amperes; then the energy needed each time the LED flashes is for example:

$$E_{flash}=Ifd*Vfd*Ton=2\text{ amperes}*21\text{ V}*20\text{ ms}=0.82\text{ joules.}$$

If the issue of conversion efficiency η (e.g. 90%) of the LED itself is also taken into account, then $E=E_{flash}/\eta=0.91$ joules. If the input voltage Vin is 32 V, and Vr needs to be greater than Vin, then Vr can be set to be equal to 35 V. In this case, the voltage Vcap to which the capacitor 240 must be charged should be at least Vmin, wherein Vmin satisfies the following formula:

$$\tfrac{1}{2}*C*(V_{min}^2-V_r^2)=E$$

$$\tfrac{1}{2}*1000\text{ uF}*(V_{min}^2=35^2)=0.91\text{ Joules}$$

to obtain:

$$V_{min}=55\text{ V.}$$

It can be seen therefrom that the minimum value Vmin to which the capacitor 240 can be charged is calculated on the basis of the input voltage Vin and the energy consumed in the flash element 260. As long as the capacitor voltage Vcap to which the booster circuit 230 charges the capacitor 240 is >=Vmin, the residual voltage Vr across the capacitor in each flash operation will be >Vin, so that a repetitive inrush current can be suppressed. This arrangement may also be used in the case of a xenon lamp.

FIG. 8 also specifically shows the specific structure of a flash control circuit 850. As FIG. 8 shows, the flash control circuit 850 is in fact a step-down circuit in which a switch element is integrated; the step-down circuit lowers the voltage across the capacitor 240 to a voltage value suitable for driving the LED 260 and controls the flash duration of the LED. Specifically, the flash control circuit 850 comprises a current sensing end Cur_Sen, a switch element Q1, an inductor L1, a voltage drop control circuit 854, and a diode D1. The switch element Q1, inductor L1 and LED 260 are connected in series, to form a series-connected path. The energy stored in the capacitor 240 powers the series-connected path. The current sensing end Cur_Sen is disposed on the series-connected path, and used to sense the size of the current flowing through the series-connected path. The voltage drop control circuit 854 makes a field effect transistor Q1 turn on or off according to the size of current sensed by the current sensing end Cur_Sen. A diode D1 is connected in parallel across the inductor L1 and LED 260, to provide a return circuit for freewheeling current in the inductor L1 when Q1 is turned off. The presence of the inductor L1 in the flash control circuit 850 enables the voltage across the capacitor to be lowered to a voltage value suitable for the LED 260. At the same time, the switch action of Q1 can also control the flash duration of the LED. In other words, in the example given in FIG. 8, the switch element is integrated in the flash control circuit. In addition, the flash control circuit in the embodiment shown in FIG. 4 may also be combined with the setting of Vmin in FIG. 8.

Figure 9:
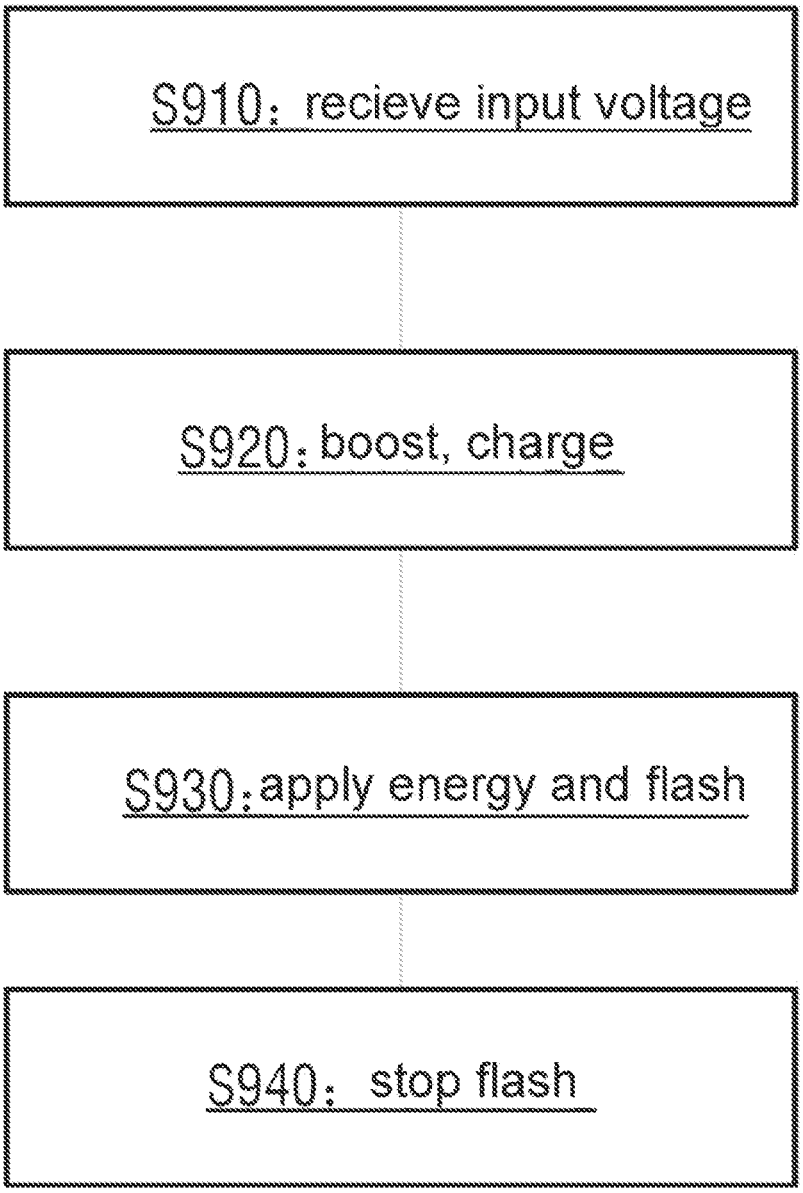
FIG. 9 shows a driving method for a visual notification device according to another aspect of the present invention.

FIG. 9 shows a driving method 900 for a visual notification device according to another aspect of the present invention. The driving method 900 comprises:

S910: receiving an input voltage Vin inputted to the notification device;

S920: boosting the input voltage Vin, and using the boosted voltage to charge an energy storage element;

S930: applying energy stored in the energy storage element to at least one flash element, to make it flash;

S940: making at least one flash element stop the flash, such that a residual voltage across the energy storage element in each flash operation is greater than or equal to the input voltage.

Preferably, the charging step may comprise: charging the energy storage element at least to a minimum voltage Vmin, wherein the minimum voltage Vmin is calculated on the basis of the input voltage Vin and the energy consumed by each flash.

Optionally, the driving method also comprises: selecting the at least one flash element such that a total intrinsic voltage drop of the at least one flash element is equal to or greater than the input voltage.

Optionally, the driving method also comprises: providing a clamping element connected in series with the at least one flash element, wherein the sum of a clamping voltage Vclamp of the clamping element and the total intrinsic voltage drop of the at least one flash element is greater than or equal to the input voltage Vin.

It should be understood that although the description herein is based on various embodiments, it is by no means the case that each embodiment contains just one independent technical solution. Such a method of presentation is adopted herein purely for the sake of clarity. Those skilled in the art should consider the description in its entirety. The technical solutions in the various embodiments could also be suitably combined to form other embodiments capable of being understood by those skilled in the art.

The series of detailed explanations set out above are merely particular explanations of feasible embodiments of the present invention, which are not intended to limit the scope of protection thereof. All equivalent embodiments or changes, such as combinations, divisions or repetitions of features, made without departing from the artistic spirit of the present invention, shall be included in the scope of protection thereof.

What is claimed is:

1. A visual notification device, comprising:

an input end that receives an input voltage;

a booster circuit coupled to the input end and configured to boost the input voltage;

an energy storage element coupled to the booster circuit and charged by the booster circuit;

at least one flash element;

a flash control circuit coupled to the energy storage element and the flash element, the flash control circuit being configured to cause energy in the energy storage element to be applied to the at least one flash element to make the at least one flash element flash;

wherein at least one of the booster circuit, the at least one flash element, or the flash control circuit is configured such that a residual voltage across the energy storage element in each flash operation is greater than or equal to the input voltage.

2. The notification device of claim 1, wherein the flash control circuit is configured to stop applying energy to the flash element before the residual voltage becomes less than the input voltage.

3. The notification device of claim 1, wherein the flash control circuit further comprises a controlled switch element connected in series with the at least one flash element, the switch element being configured to conduct during a flash and to turn off before the residual voltage becomes less than the input voltage.

4. The notification device of claim 1, wherein:

the flash element is a xenon lamp, and the switch element is an IGBT.

5. The notification device of claim 1, wherein the flash control circuit further comprises a clamping element connected in series with the at least one flash element, wherein the sum of a clamping voltage of the clamping element and an intrinsic voltage drop of the flash element is greater than or equal to the input voltage.

6. The notification device of claim 5, wherein:

the flash element comprises at least two series-connected LEDs, and the intrinsic voltage drop is the total sum of the forward voltage drops of the at least two LEDs.

7. The notification device of claim 5, wherein:

the flash element is a xenon lamp, and the intrinsic voltage drop is a residual voltage of the xenon lamp after each flash.

8. The notification device of claim 1, wherein:

the booster circuit charges the energy storage element at least to a minimum voltage, and the minimum voltage is calculated based on the energy consumed by the flash operation and the input voltage.

9. The notification device of claim 8, wherein the flash control circuit comprises a step-down circuit that lowers the voltage across the energy storage element to a voltage suitable to cause the at least one flash element to flash.

10. The notification device of claim 1, wherein:

the flash element is an LED, and the total forward voltage drop of the at least one flash element is equal to or greater than the input voltage.

11. A driving method for a visual notification device, comprising:

receiving an input voltage inputted to the notification device;

boosting the input voltage;

using the boosted voltage to charge an energy storage element;

applying energy stored in the energy storage element to at least one flash element, to make the at least one flash element flash;

making at least one flash element stop the flash, such that a residual voltage across the energy storage element in each flash process is greater than or equal to the input voltage.

12. The driving method of claim 11, wherein the charging step comprises charging the energy storage element at least to a minimum voltage, wherein the minimum voltage is calculated based on the input voltage and the energy consumed by each flash.

13. The driving method of claim 11, also comprising selecting the at least one flash element such that a total intrinsic voltage drop of the at least one flash element is equal to or greater than the input voltage.

14. The driving method of claim 11, also comprising providing a clamping element connected in series with the at least one flash element, wherein the sum of a clamping voltage of the clamping element and the total intrinsic voltage drop of the at least one flash element is greater than or equal to the input voltage.

* * * * *